US007794101B2

(12) United States Patent
Galica et al.

(10) Patent No.: US 7,794,101 B2
(45) Date of Patent: Sep. 14, 2010

(54) MICROPROCESSOR ENABLED ARTICLE OF ILLUMINATED FOOTWEAR WITH WIRELESS CHARGING

(76) Inventors: Matthias Joseph Galica, 3350 James M. Wood Blvd., Los Angeles, CA (US) 90006; Elliott Temkin, 1560 3rd St., #303, San Francisco, CA (US) 94158

( * ) Notice: Subject to any disclaimer, the term of this patent is extended or adjusted under 35 U.S.C. 154(b) by 125 days.

(21) Appl. No.: 12/291,520

(22) Filed: Nov. 12, 2008

(65) Prior Publication Data

US 2009/0193689 A1 Aug. 6, 2009

Related U.S. Application Data

(60) Provisional application No. 61/025,401, filed on Feb. 1, 2008.

(51) Int. Cl.
*F21V 21/08* (2006.01)

(52) U.S. Cl. ..... 362/103; 362/570; 362/183; 36/137

(58) Field of Classification Search ..... 362/103, 362/105, 570, 581, 183; 36/137, 71
See application file for complete search history.

(56) References Cited

U.S. PATENT DOCUMENTS 4,158,922 A * 6/1979 Dana, III ..... 36/137
5,362,267 A * 11/1994 Forrest ..... 441/16
5,483,759 A * 1/1996 Silverman ..... 36/137
5,894,686 A * 4/1999 Parker et al. ..... 36/137
6,206,537 B1 * 3/2001 Hauck ..... 362/102
6,837,590 B2 1/2005 Marston
7,254,910 B2 * 8/2007 Guzman ..... 36/136
7,255,468 B2 8/2007 Capriola
D554,848 S 11/2007 Marston
7,614,166 B2 * 11/2009 Vick et al. ..... 36/137
2006/0101674 A1 5/2006 Ungari

* cited by examiner

*Primary Examiner*—Ali Alavi
(74) *Attorney, Agent, or Firm*—Todd J. Tiberi

(57) ABSTRACT

An apparatus and system for incorporating a resilient source of high-visibility illumination into an article of footwear. A biomechanically-sound and hermetically-sealed electronics module contains a microprocessor, power source, and at least one light source, such as a light emitting diode, or LED. The LEDs are not externally visible, but rather illuminate a diffusive substrate that is incorporated into the construction of the footwear, allowing for visibility from substantially every angle above the bottom of the sole. A control panel enables the wearer to turn the power on and off, change colors, rotate through transition effects, and the like. A charging pad allows for the wireless and contact-less recharging of the onboard power source.

20 Claims, 7 Drawing Sheets

MICROPROCESSOR ENABLED ARTICLE OF ILLUMINATED FOOTWEAR WITH WIRELESS CHARGING

CROSS REFERENCE TO RELATED APPLICATIONS

This application claims the benefit of U.S. Provisional Application No. 61/025,401 filed Feb. 1, 2008.

BACKGROUND OF THE INVENTION

The present invention relates generally to an apparatus and system for illuminating footwear, and more particularly, to an electronic control circuit for powering light-emitting elements disposed within shoes. Articles of footwear have been known to incorporate light-sources such as light emitting diodes (LEDs) and electroluminescent materials to either adorn the shoe with an intermittent flash of light or a static, continuous glow. However, these applications have been limited in color change, transition effect, crossfade functionality, durability, safety, convenience, and sophistication.

It is also known in the art to incorporate a power source into an article of footwear to activate the light-emitting elements. See, for example, U.S. Pat. No. 6,837,590 (Marston). On the lower end of power consumption, it is known to incorporate either lithium coin-cell batteries or a piezoelectric material to deliver a short burst of charge to briefly flash an LED when, for example, the wearer's foot strikes the ground. On the higher end of power consumption, it is known to incorporate a replaceable non-rechargeable battery such as a standard 9-volt to power a continuous source of illumination. A shortcoming of the former approach is that the light element is not activated when the wearer is stationary, thus affording no safety protection or other benefits of visibility. Shortcomings of the latter approach are the added bulk of a larger and heavier battery, and the need for frequent replacement.

Further, the aforementioned disadvantages concerning the power source have prevented the incorporation of more sophisticated processing technologies and the corresponding gains in functionality, such as user-selected color changes or transition effects, due to the increased power requirements of these advantageous features.

Even further, the disadvantages concerning the power source in the higher end of power consumption have prevented the design of a fully-encapsulated electronic and battery module that is substantially impervious to the elements, due to the need for either battery replacement or the insertion of a power jack with conductive terminals. These difficulties have also hindered the design of an electronic and battery module that is non-obtrusive, lightweight, safe, and biomechanically sound.

Thus it is desirable to provide a device that can drive an illumination that is highly visible from all surrounding angles without the need to frequently replace, or plug into an outlet, an obtrusive, heavy, or otherwise inconvenient battery pack. Further, it is desirable to provide a user interface driven by a processor that enables the wearer to customize the user experience by, for example, being able to choose from a plurality of colors, transition effects, crossfades, and the like. Even further, it is desirable to incorporate the totality of the electronic and power components within a module that is hermetically-sealed and biomechanically-sound, thus making it durable, water-resistant, impact-resistant, safe, and non-obtrusive.

BRIEF SUMMARY OF THE INVENTION

Briefly stated, the invention comprises an apparatus and system for incorporating a resilient source of high-visibility illumination into an article of footwear. A biomechanically-sound and hermetically-sealed electronics module contains a microprocessor, power source, and at least one light source, such as an LED, though any light source consistent with the objectives of the present inventions can be used. The LEDs preferably are not externally visible, but rather illuminate a diffusive substrate that can be incorporated into the construction of the footwear, or attached to the footwear, allowing for visibility from substantially every angle above the bottom of the sole. A control panel accessible on the exterior of the shoe enables the wearer to turn the power on and off, change colors, rotate through transition effects, and other such customization. A charging pad, which is not mechanically attached to the footwear, allows for the wireless and contact-less recharging of the onboard power source. "Contact-less" refers to the concept that the footwear's internal charge circuit is not connected to the charging pad by wires, conductive terminals, or other physical connections, for the charging to occur. However, one skilled in the art will recognize that the footwear may be placed on or near the charging pad for charging to occur.

The invention is disposed on an article of footwear and can provide the safety of a high-visibility light source in environments where the wearer is at risk of injury. As such, some potential footwear embodiments include performance running and walking shoes, cycling shoes, skateboarding shoes, and work boots. The invention disclosed and claimed herein can also be used for aesthetic purposes rather than, or in addition to, safety purposes.

DETAILED DESCRIPTION OF THE INVENTION

Figure 2:
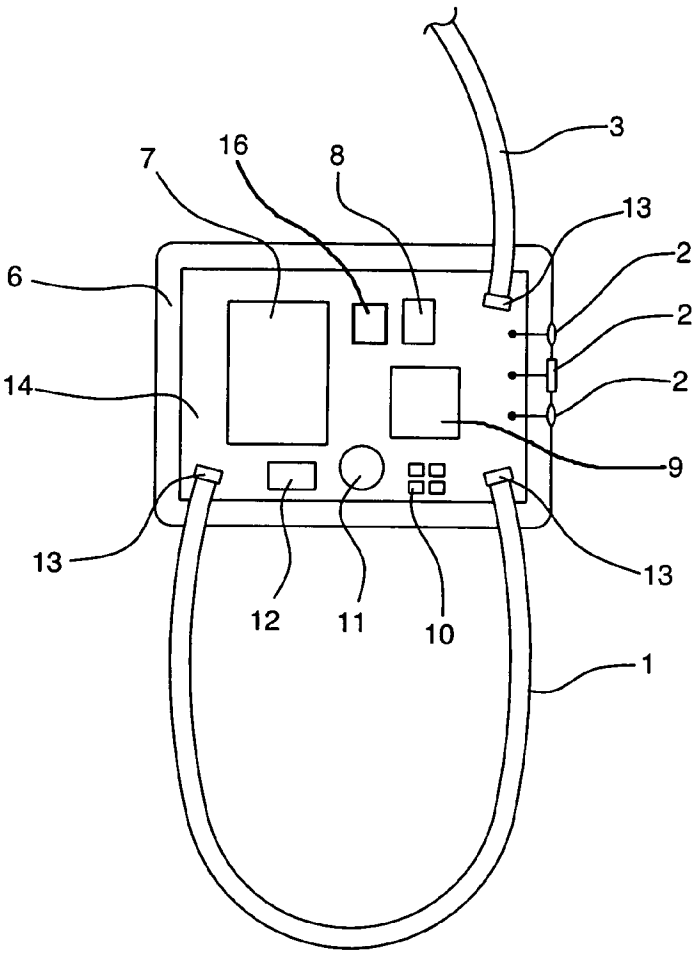
FIG. 2 is a section view through the apparatus for illuminating shoes in accordance with a first preferred embodiment of the present invention mounted on a running shoe.

Certain terminology is used in the following description for convenience only and should not be construed as limiting. The word "a" as used in the claims and in the corresponding portions of the Specification means "one or more than one." In the drawings, the same reference numerals are employed for designating the same elements throughout the figures.

FIG. 2 shows a preferred embodiment of the electronics module that serves as the processing and power center for the inputs and outputs that are disposed on the shoe or within the electronics module itself. Preferably, the electronics module housing 6 will be composed of a protective material, such as molded plastic, that hermetically seals all the components and provides a durable, water-resistant, and impact-resistant solution for surviving the rigors of the footwear application. The protective encapsulate will also add to the safety of the final product by isolating the power source 7 from contact with the wearer's foot in case of battery failure, leakage, short circuit, or other malfunction. Methods of thermoplastic overmolding are known in the art and can be done in large scale manufacturing with materials such as those provided by the Henkel company of Dusseldorf, Germany. A low-pressure molding solution that can encapsulate the printed circuit board (PCB) 14 is preferable, and a polyamide hot melt adhesive such as Henkel's Macromelt is a preferred encapsulate. Further, the bulk of the housing 6 of the electronics module can be strategically located on the medial side of the midsole construction, below the arch of the foot, in order to utilize the increased bulk and possible rigidity in a biomechanical capacity as an anti-pronation device, as is already known in the art. This is the area where many footwear manufacturers incorporate a dual density foam or rigid plastic insert in order to stabilize and counter the inward roll of the foot during impact and heel-to-toe transition when running. Since it is estimated that about 80% of the population requires this type of foot support, this is a natural preferable location for the electronic components. Of course, the electronic components can be located elsewhere that would still accomplish the objects of the invention described and claimed herein.

Figure 1:
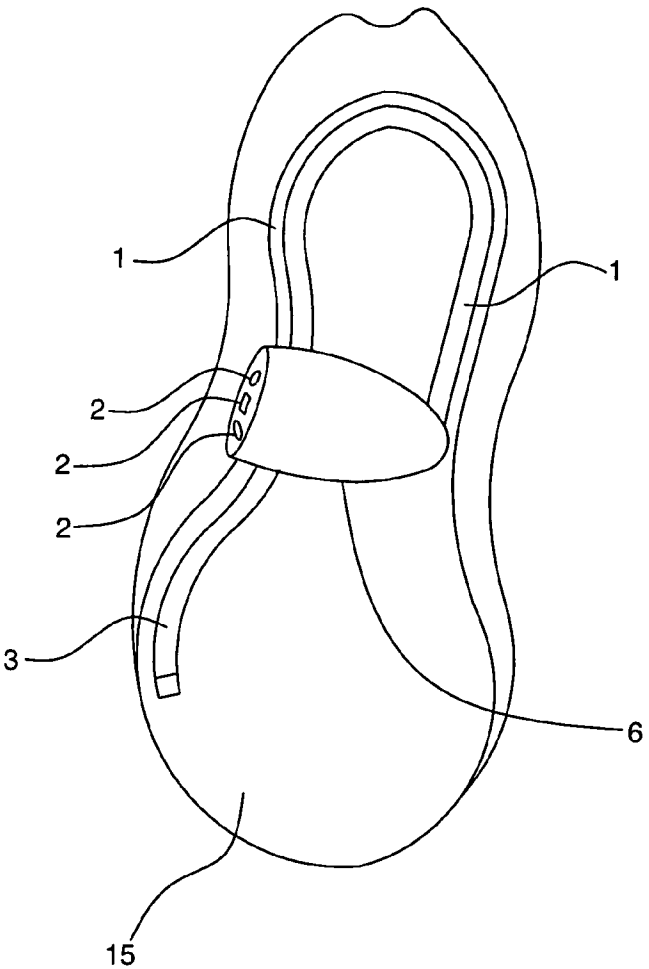
FIG. 1 is a section view through the midsole of the running shoe revealing the apparatus for illuminating shoes in accordance with a first preferred embodiment of the present invention.
Figure 4:
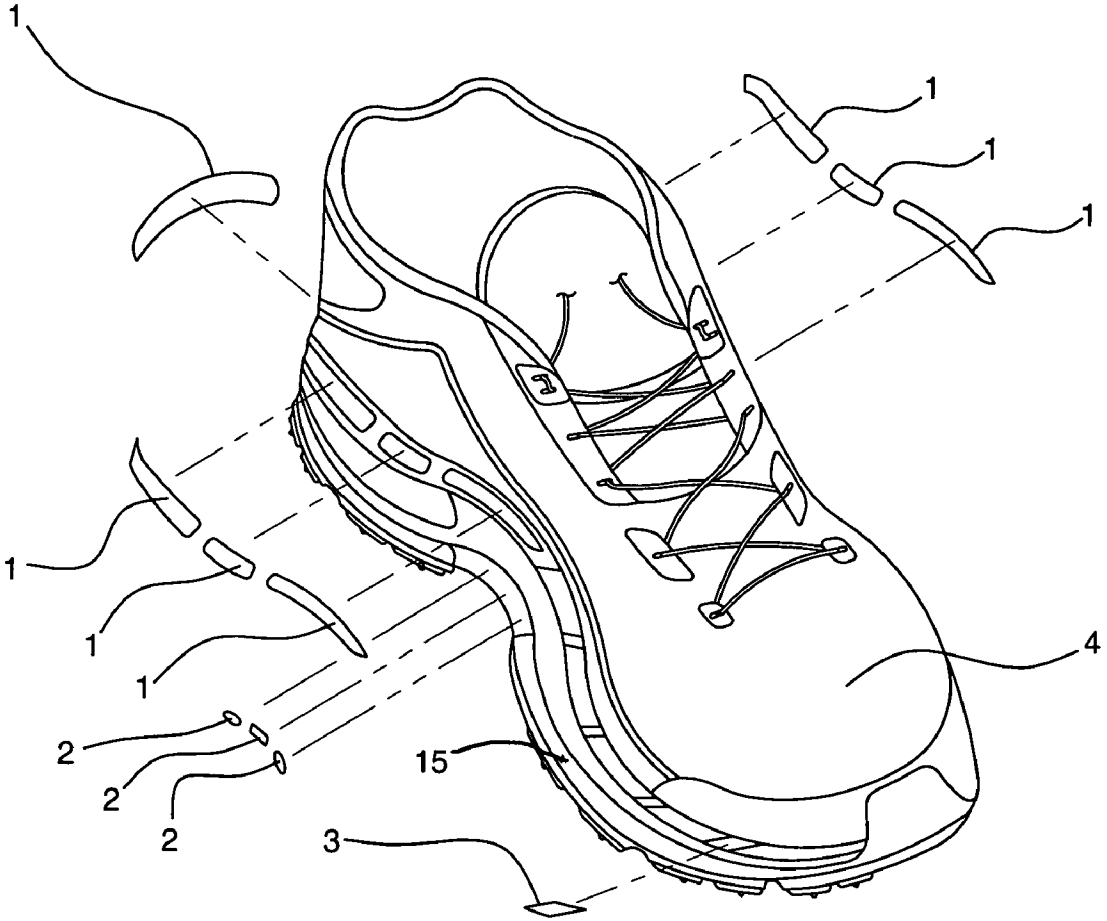
FIG. 4 is an exploded view of the components that comprise the apparatus for illuminating shoes disposed within the running shoe that are visible from the exterior of the shoe in accordance with the invention.
Figure 5:
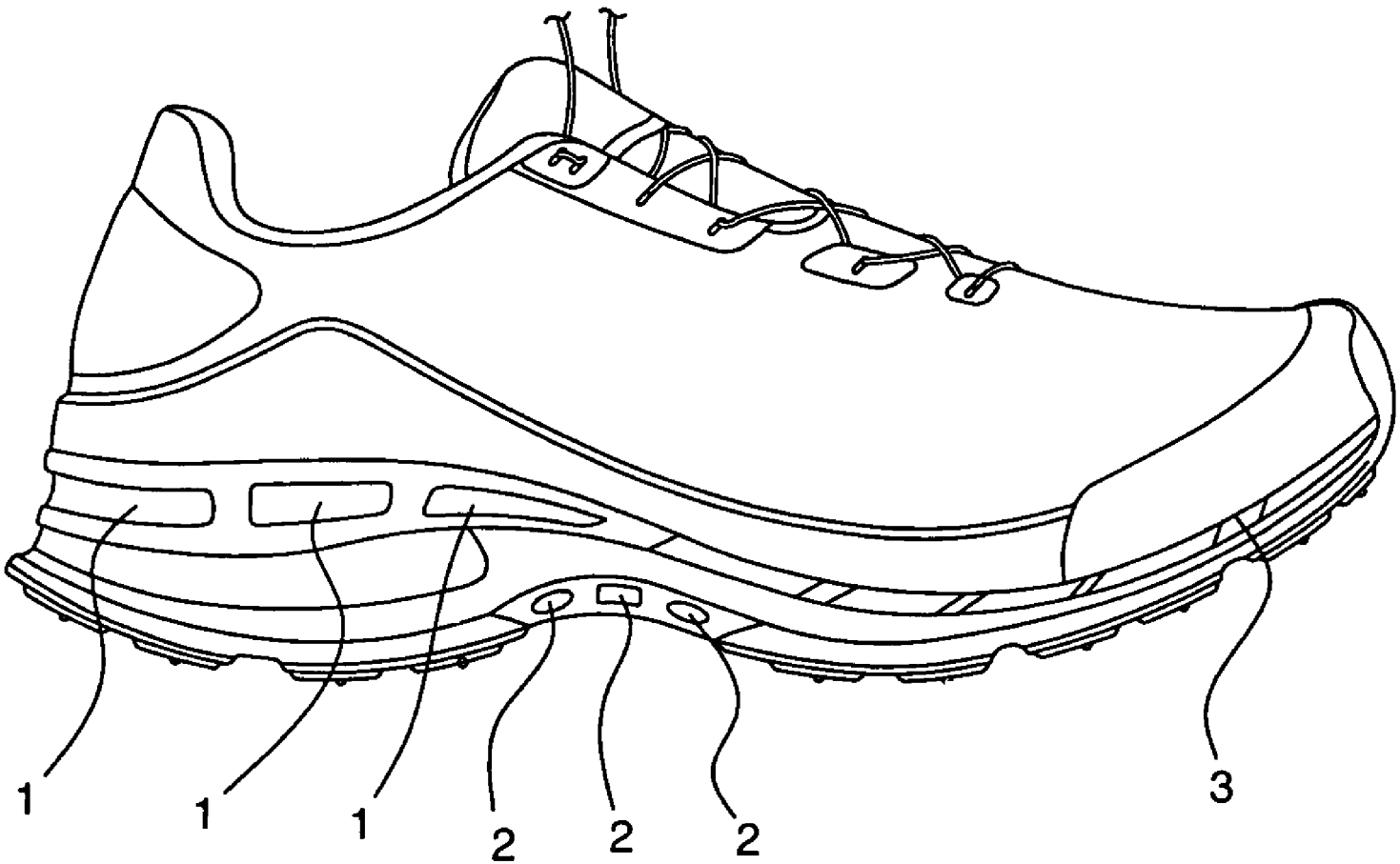
FIG. 5 is a lateral side view of an apparatus for illuminating shoes in accordance with a first preferred embodiment of the present invention mounted on a running shoe.
Figure 6:
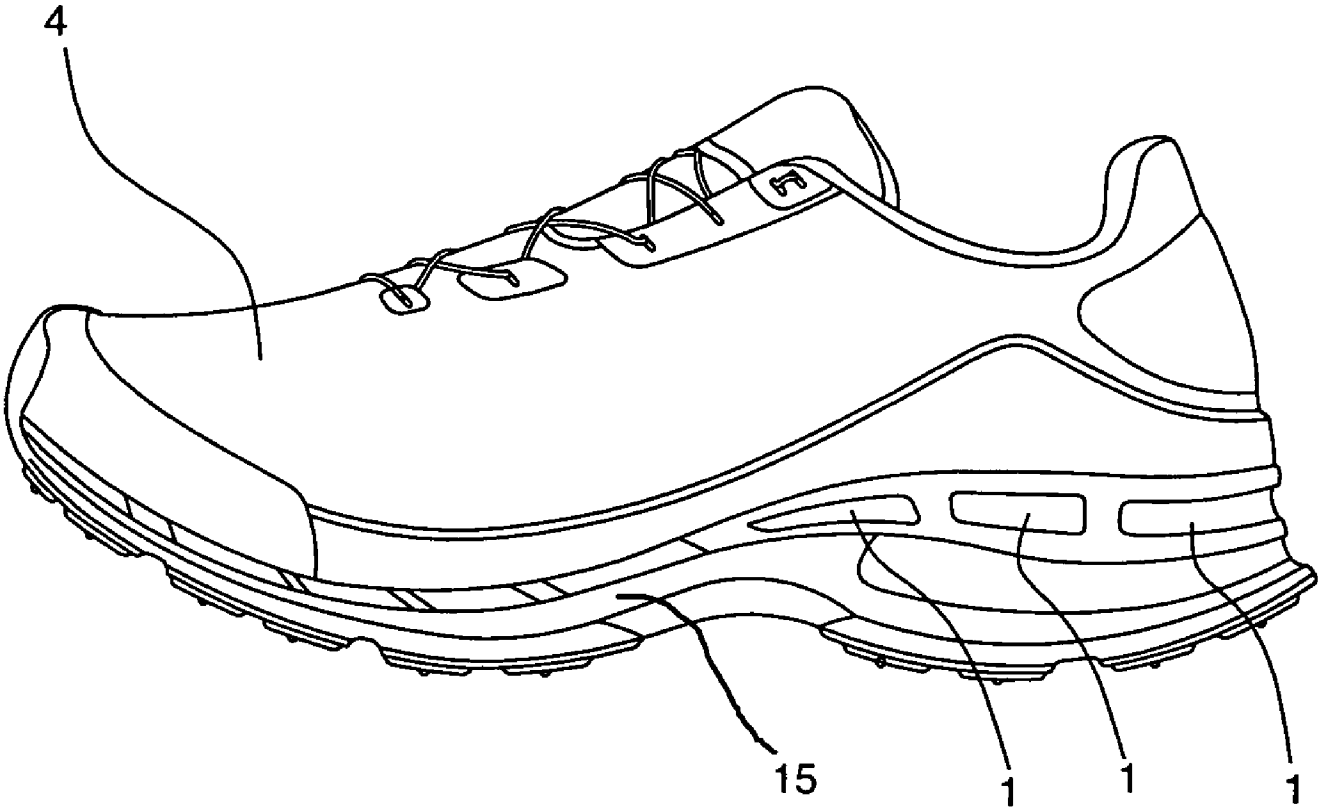
FIG. 6 is a medial side view of an apparatus for illuminating shoes in accordance with a first preferred embodiment of the present invention mounted on a running shoe.

Referring to FIG. 1, the design for the housing 6 of the electronics module can be graded to allow easier incorporation into a full range of shoe sizes. As seen in FIG. 4, for instance, the shoe includes an upper 4, which is attached to the sole 15. Preferably, the entirety of the enclosed electronics will be small enough to be suitably incorporated into the smallest desired shoe size. For ease of large-scale manufacturing, the dimensions of the enclosed electronics should not change with a variance in shoe size, while the housing 6 that contains these components may be graded. For an application in the typically smallest adult men's size (U.S. standard size 6 for men's shoes) the dimensions for the entirety of the electronic components contained within the module should be preferably no larger than 40 mm wide, 100 mm long, and 10 mm deep. In order to maintain non-obtrusiveness, the entire electronics module (including the housing 6) preferably would not weigh more than 40 grams per shoe. The net addition of weight by the electronics module should however take into account the weight of the displaced midsole cushioning material that would otherwise be located in the area now inhabited by the electronics module.

Figure 3:
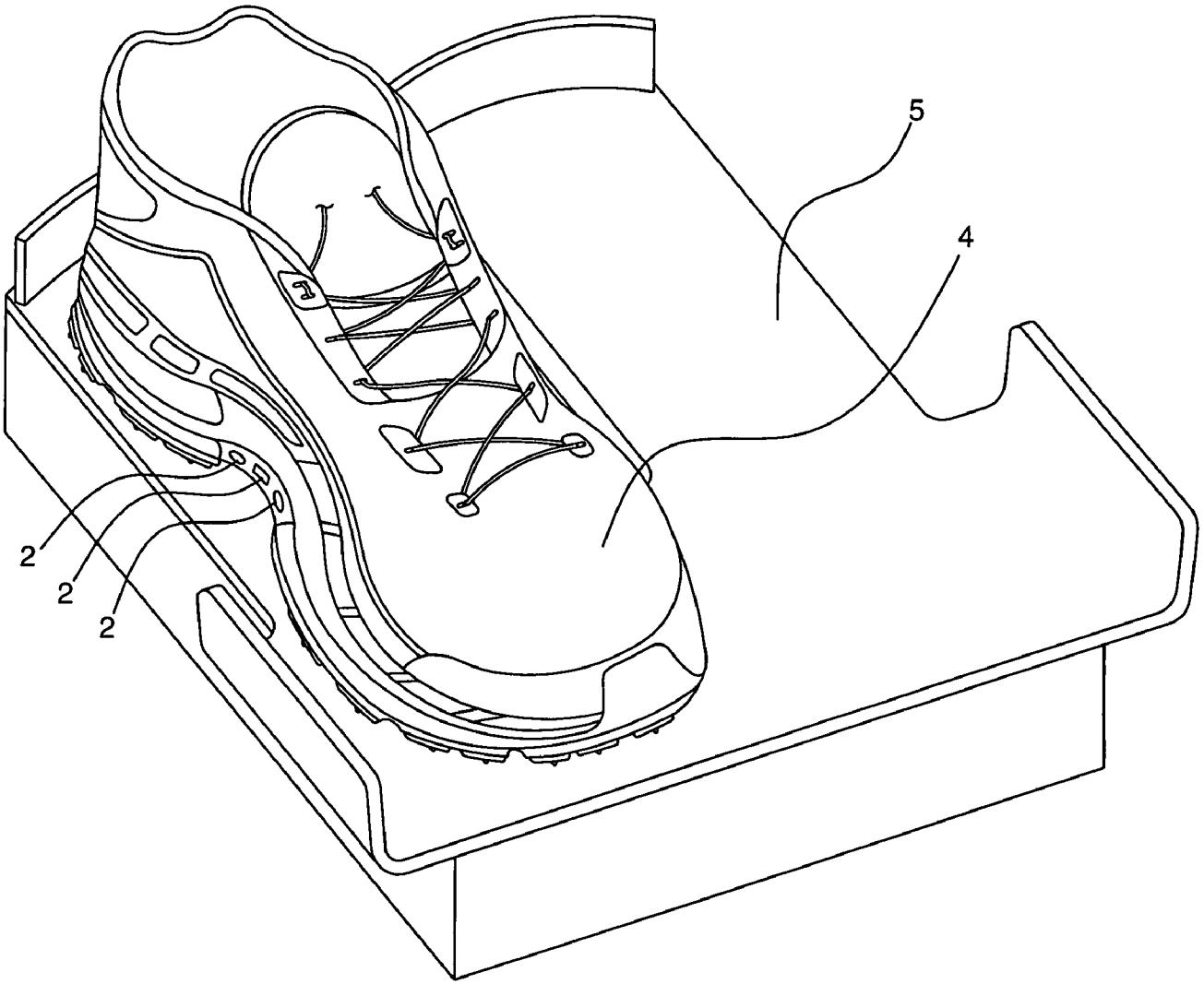
FIG. 3 is a perspective view of the system for wireless charging of the shoes in accordance with the first preferred embodiment.

FIG. 3 shows one embodiment of the charging pad 5 with one shoe of a pair of shoes placed in the charging position. The electromagnetic induction charging pad or stand will be a part of the apparatus whenever the power source within the electronics module is a rechargeable battery. Preferably, the receiving induction coil 11, shown in FIG. 2, will be constructed from wound copper wire in the smallest possible dimensions to be able to electromagnetically couple with the transmitting coil within the charging pad 5. Preferably, such charging can be achieved at a distance of approximately 25 mm, which is the combined approximate thickness of one embodiment of the plastic housing 6 of the electronic module and the plastic housing of the charging pad 5. Of course, this distance can vary depending on the particular dimensions of the housings for the electronic module and charging pad, as well as the strength of the electromagnetic coupling. The dimensions of the transmitting coil and charging pad 5 are not critical, but generally are expected to be sized to be packaged inside a standard shoebox alongside the articles of footwear; usually, the smallest possible construction is preferred. In the interest of size and weight, a custom induction coil solution is preferred. Pre-fabricated components that accomplish this wireless charging functionality, however, can also be obtained from such inductive charging manufacturers as eCoupled or, alternatively, manufacturers that offer technology based on radio frequency (RF) coupling instead of electromagnetism, such as Powercast. Alternatively, a mechanism known as evanescent wave coupling can be utilized in a fashion similar to electromagnetic induction except at a greater distance. A charging system utilizing evanescent wave coupling could be made functional by sending electromagnetic waves around in a highly angular waveguide. If a proper resonant waveguide were to be located within the electronics module of the footwear, a properly aligned transmitter within the charging device would allow DC power to be rectified in the receiving unit. Evanescent wave coupling would enable wireless charging at distances greater than 20 centimeters.

The charging pad 5 may also be constructed as a shoe tree (not shown), where an arm containing the transmitting induction coil is placed inside the article of footwear. Whether the electromagnetic charging mechanism is disposed as a pad or a shoe tree, the preferred construction is a high-impact molded plastic that is widely commercially available.

A preferred acceptable size for the receiving coil 11 can be established as is known in the art by computing the desired charge to be transferred across a given distance in a given amount of time. For instance, it may be preferable in this application to fully charge a power source with the specification of approximately 900 mAh at a nominal voltage of 3.7 in a period of no more than 12 hours. The discrete construction of this induction circuit is also known in the art in related commercial applications that also eschew the dangers (sudden battery discharge, short circuits, and complications thereof) of conductive terminals, such as electric toothbrushes. The charging pad 5 can also be constructed in a fashion that enables it to also serve as an attractive display stand for the shoes in a retail or home setting. The charging pad 5 preferably will draw electricity from a wall outlet AC power source, which is preferable because of its convenience, cost feasibility, and efficiency at wirelessly transmitting energy.

The power source 7 shown in FIG. 2 housed within the electronics module preferably can hold a charge capable of powering the onboard electronics as well as all input circuits and output circuits for a minimum of 6 hours, and preferably 8 hours or longer. The preferable power source 7 is a lithium-polymer battery such as model #UPF373581 that is commercially available from Sanyo Electronics. Lithium polymer is desirable because of its low weight and compact size. This preferable power source 7 is specified at 940 mAh, nominal voltage of 3.7, weight of 21 grams, depth of 3.6 mm, width of 34.5 mm, and length of 80.5 mm. Of course, other suitable batteries or power sources may also be used.

FIG. 2 shows an implementation of three (3) high-efficiency LEDs 13 that enable the shoe's visibility from every angle above the bottom of the sole. The three LEDs can be surface-mounted on the circuit board 14 that is disposed within the protective housing 6 of the electronics module. The preferred type of LED can be sourced from Avago. Depending on the desired selection of available colors for light displayed on the article of footwear, and the corresponding price targets for the components, the circuit board 14 can utilize either red-green-blue (RGB) LEDs, dual-color LEDs, standard single color LEDs, or some combination of the three. For an RGB LED, the preferred component is Avago's Tricolor Surface Mount ChipLED, model #HSMF-C113. For a dual-color LED, the preferred component is Avago's Bi-color Surface Mount ChipLED, model #HSMF-C156. For a single color LED, the preferred component is Avago's Right Angle ChipLED, model #ASMT-CA00.

FIG. 2 displays a preferred orientation of the surface-mounted LEDs 13 on the circuit board 14 in order to best illuminate the posterior diffusive substrate 1 and the anterior diffusive substrate 3. In short, the two rearward-facing LEDs 13 point at an acute angle relative to the anteroposterior axis in the plane of the midsole to accommodate the bend of the substrate that wraps around the heel of the article of footwear 1. The remaining third LED 13 is located on the lateral side of the circuit board 14 and is flared at a similar angle in order to illuminate the forward-facing exposure of the anterior substrate 3.

In some embodiments, the substrate itself will be disposed on the shoe in such a way to efficiently distribute the light generated from the LEDs 13 along the shoe's periphery in a manner that avoids the stress and flexion points that could damage the light-transmitting properties of the substrate. As such, a preferable substrate for this application is a side-emitting fiber optic cable such as the 7 mm Light Fiber, available from 3M. A preferred implementation of this material is displayed in FIGS. 1 and 2. The electronic module contains three entry points for the substrates 1, 3 where the substrates enter the protective housing 6 of the electronics module in order to reach the LEDs 13. The contact point between the substrates 1, 3 and protective material of housing 6 preferably is sealed during the manufacturing process in order to enhance or preserve the water-resistance and durability properties of the electronics module. This sealing can be done with a standard plastic adhesive, a tension clamp, or some combination of the two, or other known sealing methods.

Figure 7:
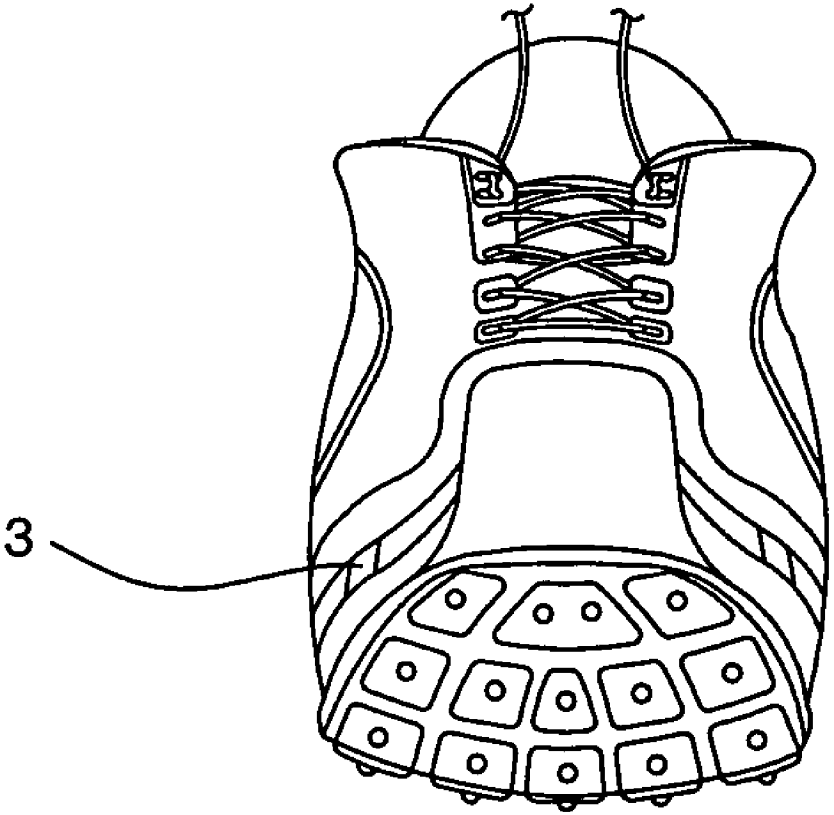
FIG. 7 is a front view of an apparatus for illuminating shoes in accordance with a first preferred embodiment of the present invention mounted on a running shoe.
Figure 8:
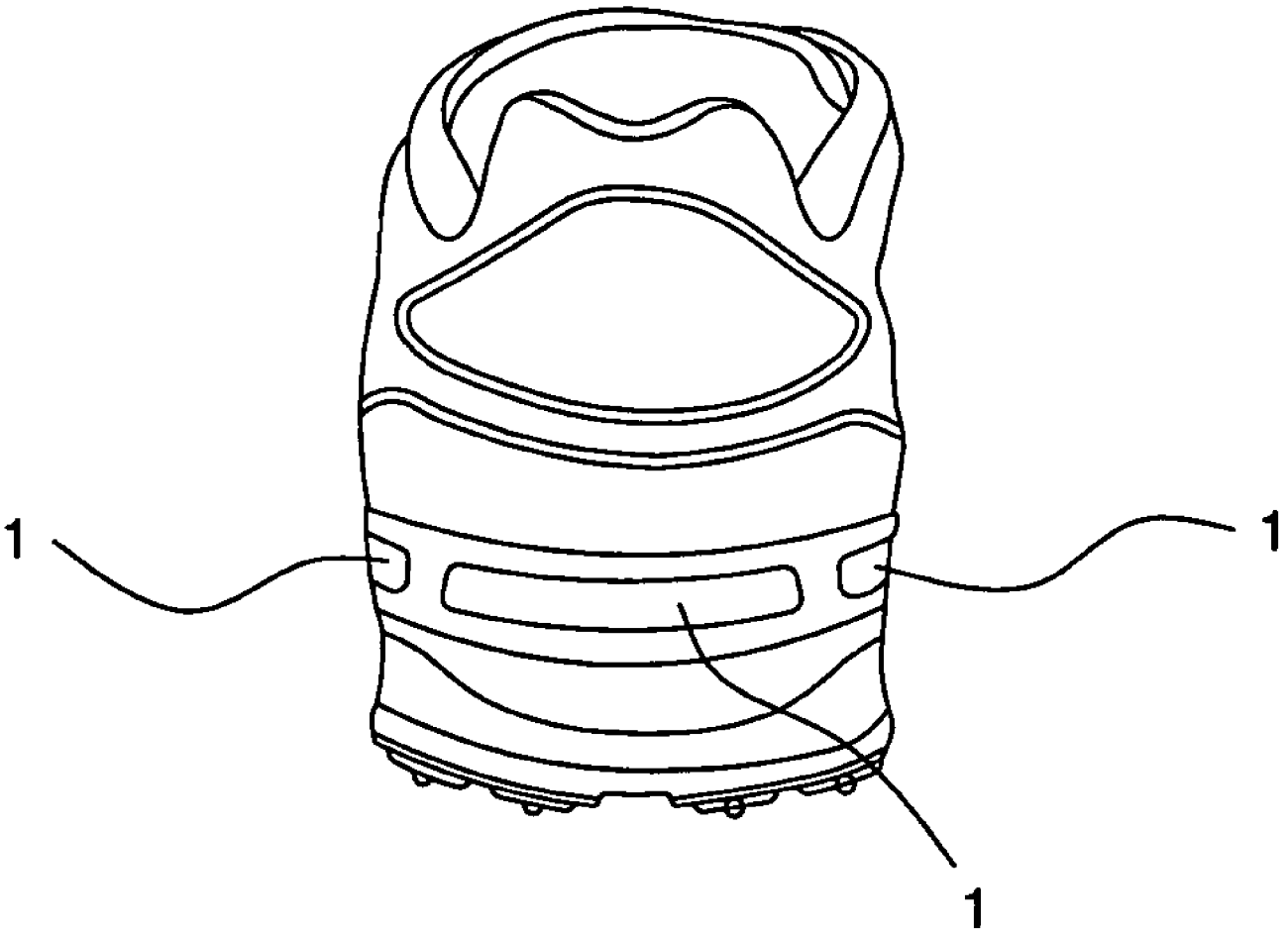
FIG. 8 is a rear view of an apparatus for illuminating shoes in accordance with a first preferred embodiment of the present invention mounted on a running shoe.

FIG. 1 shows the placement of the substrate 1, 3 on the article of footwear in one particular embodiment of the invention. A preferred placement is within the area of the midsole or outsole that contains the shoe's cushioning material. This area often contains flares, engravings, or extraneous cosmetic additions and would be well suited to accommodate the substrate 1, 3. The first length of substrate I is ported through the electronics module and is coupled with the two rearward-facing LEDs 13. This first length I then wraps around the heel of the article of footwear in such a way that it preferably provides two hundred and seventy (270) degrees of visibility to an observer. The second length of substrate 3 is coupled to the forward-facing LED 13 and is placed in such a way as to give visibility to an observer that is directly in front of the article of footwear. As FIG. 7 shows, this second length of substrate 3 not only emits light from its side, but also through the end pointing directly forward. This end of substrate 3 will terminate directly before the point where forefoot flexion occurs in the shoe, thereby reducing or avoiding the stresses of locating a part of the fiber optic in this area of the shoe while still directing the illumination forward preferably for the remaining ninety (90) degrees of visibility. Although possessing a full 360 degrees of visibility is not critical to the invention, one desirable objective of the invention is to provide safety visibility from all angles above the bottom of the sole.

In order to process the illumination and the corresponding effects, the electronics module can be controllable by a control panel and a corresponding control circuit, including a simple microprocessor 9 as shown in FIG. 2, preferably one that contains at least 10 kilobytes of onboard memory, like those that can be obtained from Cypress Semiconductors. The microprocessor 9 and supporting electronics, including control buttons 2, battery 7, motion sensor 8, ambient light sensor 16, LED drivers 10, wireless charging receiver 11, voltage regulator 12, and LEDs 13, can be disposed on a standard fiberglass resin circuit board 14 that will preferably be a custom shape and size to accommodate the constraints of this application. The aforementioned electronic components are integral elements of the control circuit, which processes user-provided inputs in order to control the illumination and functionality of the invention. Of course, other components that suitably achieve the objectives of this invention may also be used. The buttons 2 are a preferred implementation of the control panel, through which the user supplies inputs to the control circuit.

Color change and various transition and other effects are available to the wearer in order to add greater visibility and aesthetic appeal options. These options will be present so that the wearer can select them according to the varying demands of the environmental scenarios where the visibility-dependent safety hazard exists. Or the wearer can simply customize the shoe based on aesthetic desires. If the electronics module contains RGB LEDs, the software programmed onto the microprocessor 9 can provide the user with some or all of the following options: the ability to turn the effect on and off, the ability to select from a plurality of colors capable of being generated by the RGB LED, the ability to select from a plurality of fade effects that alter the brightness of illumination, the ability to manually control the static brightness of the illumination, the ability to select from transition effects that control the appearance of multiple colors in a rotating sequence, and the ability to activate the control of these effects by an onboard motion sensor 8 or ambient light sensor 16 for automatic operation. For an application utilizing dual-color or single-color LEDs, the aforementioned functionality can be achieved and may be limited only by the variety of discrete colors available.

The preferable modes of controlling the output of LEDs are known in the art as pulsewidth modulation and current control. Additionally, the controller programming can bypass the need for custom coding of these effects by utilizing a third-party hardware component such as the EZ-Color Hardware Controller available from Cypress Semiconductors.

For controlling the illumination and corresponding effects, in one preferred embodiment, the electronics module can draw upon the input of a motion sensor 8 integrated onto the circuit board 14. The motion sensor 8 will detect the presence of a wearer in the shoes and will activate the effect accordingly. A preferable type of motion sensor is one that is known in the art as a piezoelectric switch. A more advanced type of motion sensor is a simple accelerometer of the microelectromechanical systems variety, or MEMS. The light effect may also utilize the input of a tactile button or buttons 2 placed on an exposed segment of the electronics module housing 6. This button or buttons 2 can enable the wearer to turn the effect on and off, change the frequency of the intermittent pulses, or set the microprocessor 9 to trigger the effects only where the motion sensor 8 is activated. The preferable type of button is a soft-touch tactile button such as those provided by Eleksen or Judco.

FIG. 2 shows an embodiment that includes an ambient light sensor 16, which can be incorporated into the electronics module and can be exposed to the ambient environment through a visible portion of the housing 6 of the module. The ambient light sensor 16 can be utilized to give the user the ability to trigger the activity of the onboard electronic once the environmental illumination reaches a certain threshold level of darkness. In this way, the user can be spared the necessity of turning the effects on and off in response to, for example, the time of day. Ambient light sensors 16 are readily available, for example the Miniature Surface-Mount Ambient Light Photo-Sensor made by Avago, model #APDS-9002.

One reasonably skilled in the art will not only recognize that the invention herein can be applied to a wide range of safety footwear applications, but certain embodiments may possess an aesthetic or artistic appeal as well. The sustained illuminated and eye-catching effects of certain embodiments of the invention are intended to enhance and improve on what has become a desirable stylish aesthetic for fashionable footwear. However, a performance footwear or hybrid performance/fashion application can provide improved visibility for walkers, joggers, and runners who exercise during the night hours, or other low-visibility periods, that put them at increased risk of collisions with motorists. Similarly, a cycling shoe application can provide this safety benefit to cyclists. Further, incorporating this apparatus into a work boot can serve individuals whose occupations put them at risk for accidents created by low-visibility situations, such as road construction workers, airport crews, law enforcement, firefighters, and so forth.

From the foregoing, it can been seen that the present invention comprises an electronic module, apparatuses and systems for allowing user inputs, and apparatuses and systems for driving illuminated substrates and the like disposed in or on shoes. It will be appreciated by those skilled in the art that changes could be made to the embodiments described above without departing from the broad inventive concepts thereof. It is understood, therefore, that this invention is not limited to the particular embodiments disclosed, but is intended to cover modifications within the spirit and scope of the present invention as defined by the appended claims.

We claim:

1. An illuminated shoe comprising:

a modular housing disposed within the shoe, the housing including a control circuit, power source, and light source, the control circuit, power source, and light source electronically connected within the housing, and the power source capable of being charged wirelessly;

a control panel disposed on or within the shoe, the panel electronically connected to the control circuit and capable of activating the light source; and a diffusive substrate disposed on or within the shoe, wherein the substrate carries light from the light source and distributes it around the shoe.

2. The illuminated shoe of claim 1, wherein the power source is a rechargeable battery that may or may not be replaceable.

3. The illuminated shoe of claim 1, wherein the light source is one or more RGB LEDs capable of reproducing a plurality of colors.

4. The illuminated shoe of claim 1, wherein the control circuit contains a microprocessor with the ability to process instructional code.

5. The illuminated shoe of claim 4, wherein the instructional code enables the one or more RGB LEDs to enter a power-saving sleep mode.

6. The illuminated shoe of claim 4, wherein the instructional code can cause the one or more RGB LEDs to exhibit effects selected from the group consisting of: change colors, rotate through a selection of colors, adjust level of brightness, reproduce a crossfade effect that blends the transition from one color to the next, and reproduce a brightness transition effect where the level of illumination continually increases then decreases in a visible pulse of variable frequency.

7. The illuminated shoe of claim 4, wherein the control circuit contains a motion sensor that detects the wearer's movement.

8. The illuminated shoe of claim 4, wherein the control circuit contains an ambient light sensor that detects the level of environmental illumination.

9. The illuminated shoe of claim 7, wherein the motion sensor is able to trigger sleep mode due to inactivity.

10. The illuminated shoe of claim 7, wherein the motion sensor is able to trigger a color change or other illumination effect based on the wearer's movement.

11. The illuminated shoe of claim 8, wherein the ambient light sensor is able to trigger a change in the light source's output based on the level of ambient light.

12. The illuminated shoe of claim 1, wherein the modular housing is located in a biomechanically sound location within the shoe and is graded to fit a range of different shoe sizes, and the size and arrangement of the electronics inside the housing stays substantially the same regardless of the size of the shoe.

13. The illuminated shoe of claim 1, wherein the control panel includes buttons that provide a tactile feedback.

14. The illuminated shoe of claim 1, wherein the control panel includes buttons and is disposed on the exterior of the modular housing.

15. The illuminated shoe of claim 1, wherein the control panel includes buttons and is disposed on the upper of the shoe.

16. The illuminated shoe of claim 1, wherein the diffusive substrate is a fiber optic material.

17. A system for an illuminated shoe comprising:

a modular housing disposed within the shoe, the housing including a control circuit, power source, and light source, the control circuit, power source, and light source electronically connected within the housing, and the power source capable of being charged wirelessly;

a control panel disposed on or within the shoe, the panel electronically connected to the control circuit and capable of activating the light source;

a diffusive substrate disposed on or within the shoe, wherein the substrate carries light from the light source and distributes it around the shoe; and a charging pad capable of wirelessly charging the power source.

18. The system for an illuminated shoe of claim 17, wherein the charging pad is capable of charging the power source in the absence of conductive terminals, power jack insertion points, or metallic contacts for energy transmission between the charging pad and the power source.

19. The system for an illuminated shoe of claim 17, wherein the charging pad is physically separate from the shoe and utilizes a wireless energy transmission technology selected from the group consisting of electromagnetic induction, near-field radio frequency coupling, and evanescent wave coupling.

20. The system for an illuminated shoe of claim 17, wherein the charging pad is a shoe tree, base station, or some other form factor that allows for continuous contact between the charging pad and shoes in a resting state, and the charging pad can be powered by a standard electrical outlet.

* * * * *